US007708008B2

(12) United States Patent
Elkasevic et al.

(10) Patent No.: US 7,708,008 B2
(45) **Date of Patent: *May 4, 2010**

(54) DOUBLE OVEN COMBINATION WITH AN INTEGRATED COOLING AIR AND EXHAUST AIR FLOW ARRANGEMENT

(75) Inventors: Suad Elkasevic, Winterville, NC (US); George May, New Bern, NC (US); Mike Penuel, Cedar Point, NC (US); Kevin W. Sherbert, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 245 days.

This patent is subject to a terminal disclaimer.

(21) Appl. No.: 11/703,554

(22) Filed: Feb. 6, 2007

(65) Prior Publication Data

US 2008/0185373 A1 Aug. 7, 2008

(51) Int. Cl.
*A21B 00/26* (2006.01)
*A21B 1/14* (2006.01)

(52) U.S. Cl. ..... 126/198; 126/21 A; 126/19 R; 126/190; 126/193; 219/394; 312/236

(58) Field of Classification Search ..... 126/198, 126/200, 21 A, 25 R, 299; 219/385–405
See application file for complete search history.

(56) References Cited

U.S. PATENT DOCUMENTS

| | | | | |
|---|---|---|---|---|
| 4,354,084 | A * | 10/1982 | Husslein et al. | 219/757 |
| 5,738,081 | A * | 4/1998 | Puricelli | 126/21 A |
| 5,957,557 | A | 9/1999 | Langer et al. | |
| 6,166,353 | A | 12/2000 | Senneville et al. | |
| 6,913,012 | B2 * | 7/2005 | Divett et al. | 126/21 A |
| 6,967,310 | B2 * | 11/2005 | Austin et al. | 219/408 |

* cited by examiner

*Primary Examiner*—Steven B McAllister
*Assistant Examiner*—Nikhil Mashruwala
(74) *Attorney, Agent, or Firm*—James E. Howard; Andre Pallapies

(57) ABSTRACT

A double oven combination is configured to be "built-in" an area of a household—in other words, permanently secured relative to the household area and integrated with other elements of the household area to provide a consistent decorative appearance. The double oven combination comprises an upper oven and a lower oven each of which may be a convection or non-convection oven that cooks and heats food and other substances via radiant and convective heating, and a control panel. The double oven combination has an integrated cooling air and exhaust air flow arrangement for efficiently guiding exhaust air away from the upper oven and the lower oven while at the same time effectively flowing cooling air relative to the double oven combination to promote desired cooling of the double oven combination.

5 Claims, 11 Drawing Sheets

DOUBLE OVEN COMBINATION WITH AN INTEGRATED COOLING AIR AND EXHAUST AIR FLOW ARRANGEMENT

BACKGROUND OF THE INVENTION

The invention disclosed herein relates generally to an integrated cooling air and exhaust air flow arrangement for influencing the heat dissipation of a double oven combination, and more particularly to an integrated cooling air and exhaust air flow arrangement having a cooling air only guiding path for guiding cooling air downwardly to a base channel extending below the lower oven of the double oven combination.

Cooking appliances have been available, for example, in configurations known as built-in wall ovens and one type of built in oven that is commercially available is a double oven which features two independently operable convection or non-convection ovens. Such double ovens can be installed in a kitchen of a home residence, another room of a home residence, or in other settings in a manner such that one of the pair of ovens is located above the other of the pair of ovens. Moreover, one commercially available configuration of a double oven comprises as well as single control panel element, typically located above the uppermost one of the pair of ovens, that can control the operations of both ovens.

Built-in wall ovens can offer advantages such as convenient single-location access for items to be cooked, such as foodstuffs and the like. Additionally, if both ovens are operated in overlapping manner—i.e., foodstuffs are heated in both the upper and lower ovens during overlapping time periods—then the heat produced by both ovens mutually reinforces the heat retention insulative effect that operates to promote good heat retention by the ovens and, thus, less energy consumption by the ovens in producing their heat. While built-in wall ovens can offer advantages such as noted above, there are several factors to consider concerning the installation of built-in units. U.S. Pat. No. 5,957,557 notes that, in the kitchen area, appliances are installed either as upright units or, more widely, as built-in units. U.S. Pat. No. 5,957,557 further notes that appliances which are built in require extensive modifications to the wooden carcass and facings with front panels which match the other kitchen units. U.S. Pat. No. 5,957,557 further describes other perhaps detrimental aspects of such built-in units, including the fact that wood is sensitive to dampness and the effects of heat and the requirement to provide each appliance with its own power supply, often requiring installation to be carried out by a specialist electrician. Moreover, U.S. Pat. No. 5,957,557 notes that the electrical appliances of such built-in units are generally not stackable for static reasons.

U.S. Pat. No. 6,166,353 discloses a free-standing warming appliance 10 that can optionally be provided with a pair of oven support members 210 to directly support a built-in oven 14 and, in this respect, the free-standing warming appliance 10 and built-in oven 14 supported thereon may present one solution for installing a built-in unit. Each of the oven support members 210 is inverted-U-shaped in cross section and has inner walls that form a plurality of spaced-apart engagement arms 218 with mounting tabs 220 provided at their lower ends. The tabs 220 are sized to be inserted into a plurality of spaced-apart and collinear slots 222 formed in the top panel 76 of a warming drawer.

According to U.S. Pat. No. 6,166,353, each of its support members 210 is attached to the warmer drawer chassis 20 by inserting the tabs 220 into the slots 222 in the outer enclosure top panel 76 so that the arms 218 engage the top panel 76. Screws are then inserted to attach the outer wall 216 to the outer enclosure lateral walls 70, 72. It is readily apparent from the above description that the support members 210 can be installed and removed with access to only the lateral sides of the warming appliance 10. With each of the support members 210 attached to the warming appliance 10, the top walls 210 of the support members 210 are generally parallel and spaced-apart to form a generally horizontal support plane 223 for the built-in oven 14. As shown in FIG. 14 of U.S. Pat. No. 6,166,353, the oven 14 rests directly on the support member top walls 212 within a cabinet in a kitchen. Therefore, the free-standing warming appliance 10 directly supports the built-in oven 14.

Additionally, as shown in FIGS. 1 and 15 of U.S. Pat. No. 6,166,353, the free-standing warming appliance 10 can optionally be provided with a pair of cabinet support brackets 224. each having a generally planar main wall 226 and a tab 228 extending generally perpendicularly therefrom. The tabs 228 provide forward facing engagement surfaces that engage the rear surface of a cabinet front panel of a kitchen to prevent the chassis 20 of the warming appliance 10 from being pulled out of the cabinet 12 when the warmer drawer 22 is pulled out of the chassis 20.

A common design consideration that must be taken into account for all built in double oven installation scenarios is that an appropriate flow of cooling air and an appropriate removal of heated exhaust air must be provided for a number of reasons. For example, such cooling air flows and heated exhaust air removal must be arranged such that the selected cooking temperatures in the ovens are maintained. In connection with maintaining the selected oven cooking temperatures, it is typically provided that a predetermined quantity of heated exhaust air is removed from an oven. This removed heated exhaust air often comprises entrained cooking residues such as food particulates, steam vapor, grease matter, and other substances and the heated exhaust air must then be guided away from the ovens such that these substances do not contact and accumulate upon, for example, electrical wiring, is located next to the ovens. Additionally, it is frequently desired to introduce cooling air—in the form of air at the ambient temperature of the kitchen or other room in which the double ovens are located—to thereby achieve cooling of selected components of the double oven. For example, one design constraint is that oven door outer surfaces including oven door handles must not exceed a specified temperature. Thus, there is a need to provide, with respect to built-in units comprised of household appliances, and, in particular, a built in double oven, a cooling air and exhaust air flow arrangement for efficiently guiding exhaust air away from the upper oven and the lower oven while at the same time effectively flowing cooling air relative to the double oven combination to promote desired cooling of the double oven combination.

SUMMARY OF THE INVENTION

According to one aspect of the present invention, there is provided an integrated cooling air and exhaust air flow arrangement for influencing the heat dissipation of a double oven combination formed of two ovens arranged with one oven above and relatively proximate to the other oven. The an integrated cooling air and exhaust air flow arrangement includes a first air guiding path for guiding a mixture of cooling air and air that has been exhausted from the upper oven, a second air guiding path for guiding a mixture of cooling air and air that has been exhausted from the lower oven, and a cooling air only guiding path for guiding cooling air with all of the first guiding air guiding path, the second air guiding path, and the cooling air only guiding path guiding their respective air mixtures downwardly to a base channel extending below the lower oven. The second air guiding path includes a mid-channel formed above the lower oven and below the upper oven with cooling air entering the mid-channel from outwardly of the upper and lower ovens and mixing in the mid-channel with heated air that has exited a top portion of an oven door that selectively closes and permits access to an access opening of an oven cavity of the lower oven. Also, the cooling air only guiding extends from the cooling air entry above the upper oven to the base channel extending below the lower oven and the cooling air only guiding path is segregated from the first air guiding path and the second air guiding path.

In accordance with further details of the one aspect of the present invention, the integrated cooling air and exhaust air flow arrangement additionally includes a latch plate shield located above the access opening of the oven cavity of the lower oven and below the upper oven.

In accordance with yet further details of the one aspect of the present invention, the latch plate shield is cooperatively configured with respect to the top portion of the oven door of the lower oven for influencing heated air exiting the top portion of the oven door to enter the mid-channel of the second air guiding path and latch plate shield assembly including at least one cooling air aperture for the entry of cooling air into the mid-channel of the second air guiding path, whereby the integrated cooling air and exhaust air flow arrangement efficiently guides exhaust air away from the upper oven and the lower oven while at the same time effectively flowing cooling air relative to the double oven combination to promote desired cooling of the double oven combination.

In accordance with further details of the one aspect of the present invention, the latch plate shield includes a protruding bill element that protrudes outwardly in the direction toward the area of the structure in which the double oven is installed. Additionally, the protruding bill element includes an outermost edge that extends nearly to an inside surface of the oven door of the lower oven when the oven door is in its oven cavity closing disposition.

DETAILED DESCRIPTION OF THE INVENTION

Figure 1:
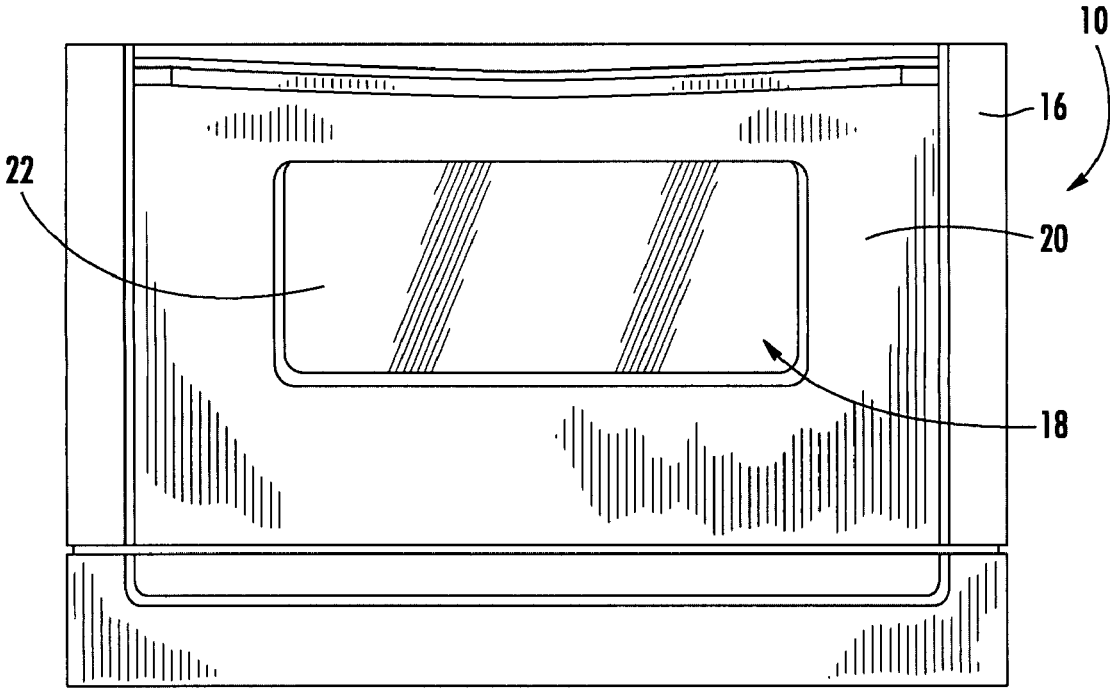
FIG. 1 is a perspective view of a self-cleaning oven.
Figure 2:
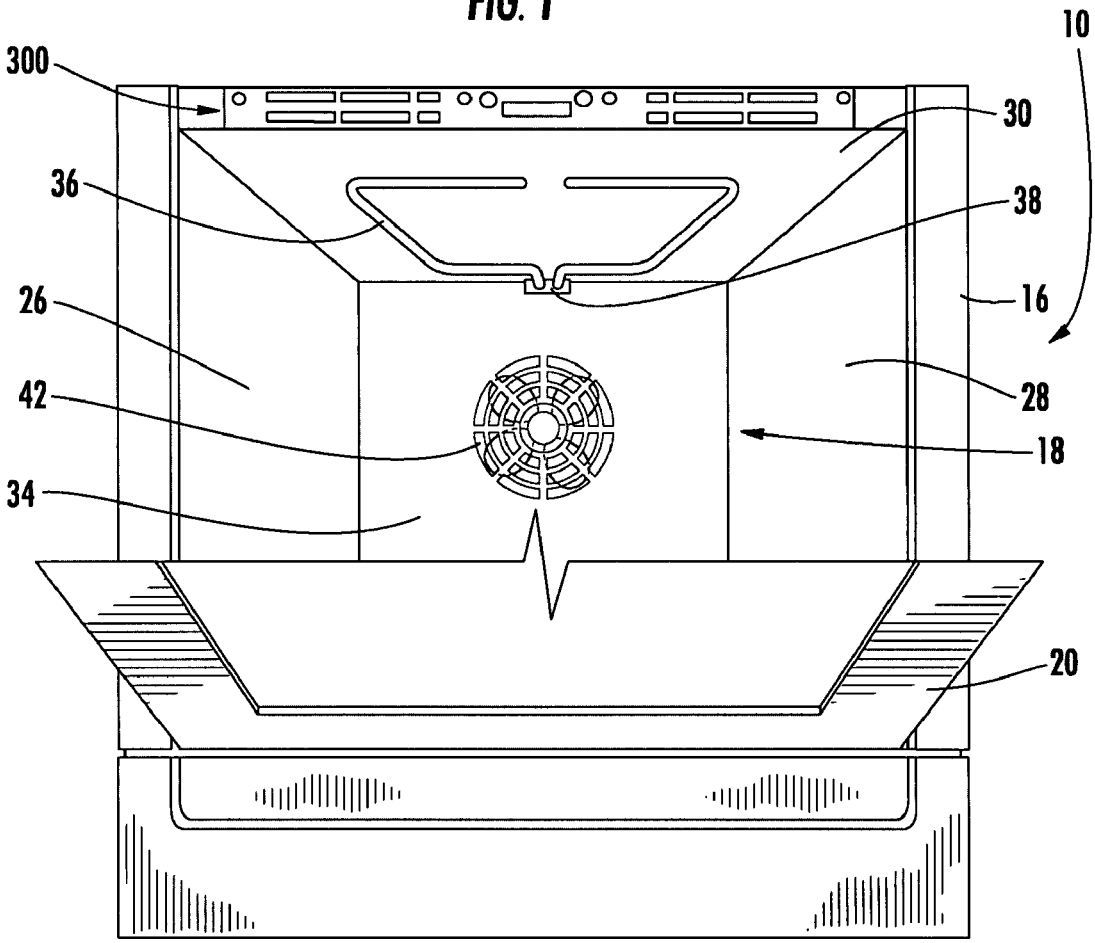
FIG. 2 is a front plan view of the oven of FIG. 1.

Referring now to FIGS. 1 and 2, an electric or gas oven or range 10 ("oven" is used for ease of reference hereinafter) is operable to cook and heat foodstuffs and other substances. Two units of the oven 10 can be arranged relative to one another to form a double oven combination and, additionally, such a double oven combination can be configured to be "built-in" double oven that is installed in a recessed manner in, for example, an area of a household—in other words, permanently secured relative to the household area and integrated with other elements of the household area to provide a consistent decorative appearance. Such a double oven combination may be comprised of two ovens each of which is a unit configured identically to the oven 10 described hereinabove with one of these ovens being an upper oven disposed at a predetermined spacing above the other oven (the lower oven) and can include an associated single control panel for controlling the operation of both the upper and lower ovens.

Figure 9:
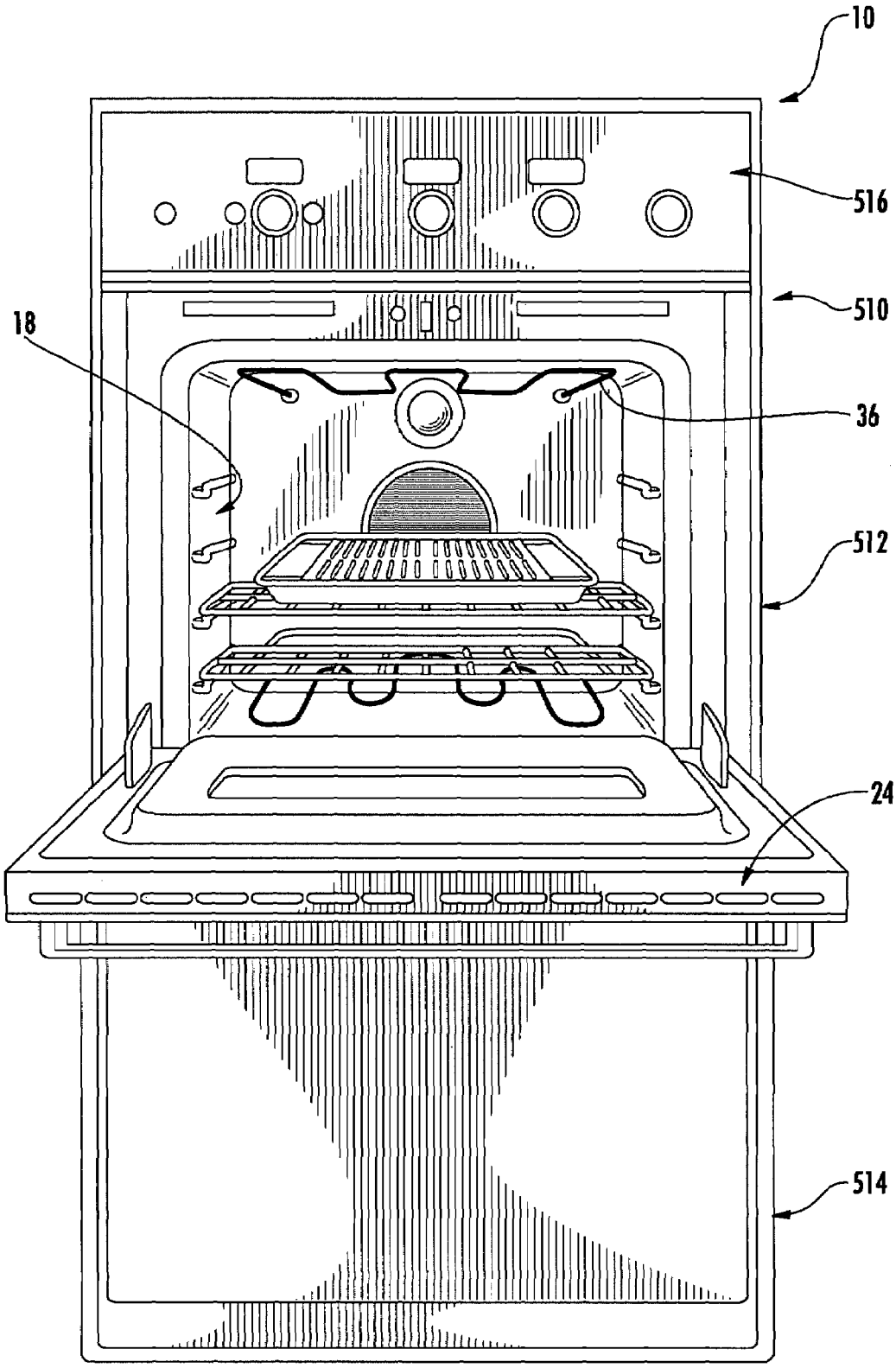
FIG. 9 is a front plan view of a double oven combination configured to be installed as a built-in combination in an area of a household.

Continuing then with a description of the oven 10, the oven 10 can be operable as either an upper oven or a lower oven and includes a frame 16, with an oven cavity 18 closed by an oven door assembly 20. The oven door assembly 20 includes a window 22 for the user to view the inside of the oven cavity 18, such as to view food cooking in the oven cavity 18. As seen in FIG. 9, a plurality of door flow exit apertures 24 are formed in the top surface of the door 20. The operation of the oven cavity 18 is controlled by the user utilizing the associated single control panel. A self-cleaning operation of the oven cavity 18 is controlled by operation of the associated single control panel.

With reference to FIG. 2, the oven cavity 18 generally has side walls 26 and 28, a top wall 30, a bottom wall 32, and a back wall 34. In the immediate vicinity of the top wall 30, where the oven is an electric oven, an interior or broil heating element (resistance coil) 36 can be disposed for grilling or broiling. The broil heating element 36 can be of any heating element known in the art and is in contact with a plug 38, for example, or another type of connecting element through its electrical terminals. In a gas oven, it is understood that gas burners within the oven cavity will be connected with a source of gas. An impeller or fan 42 can be located in the vicinity of back wall 34 for conducting air circulation within oven cavity 18.

Figure 3:
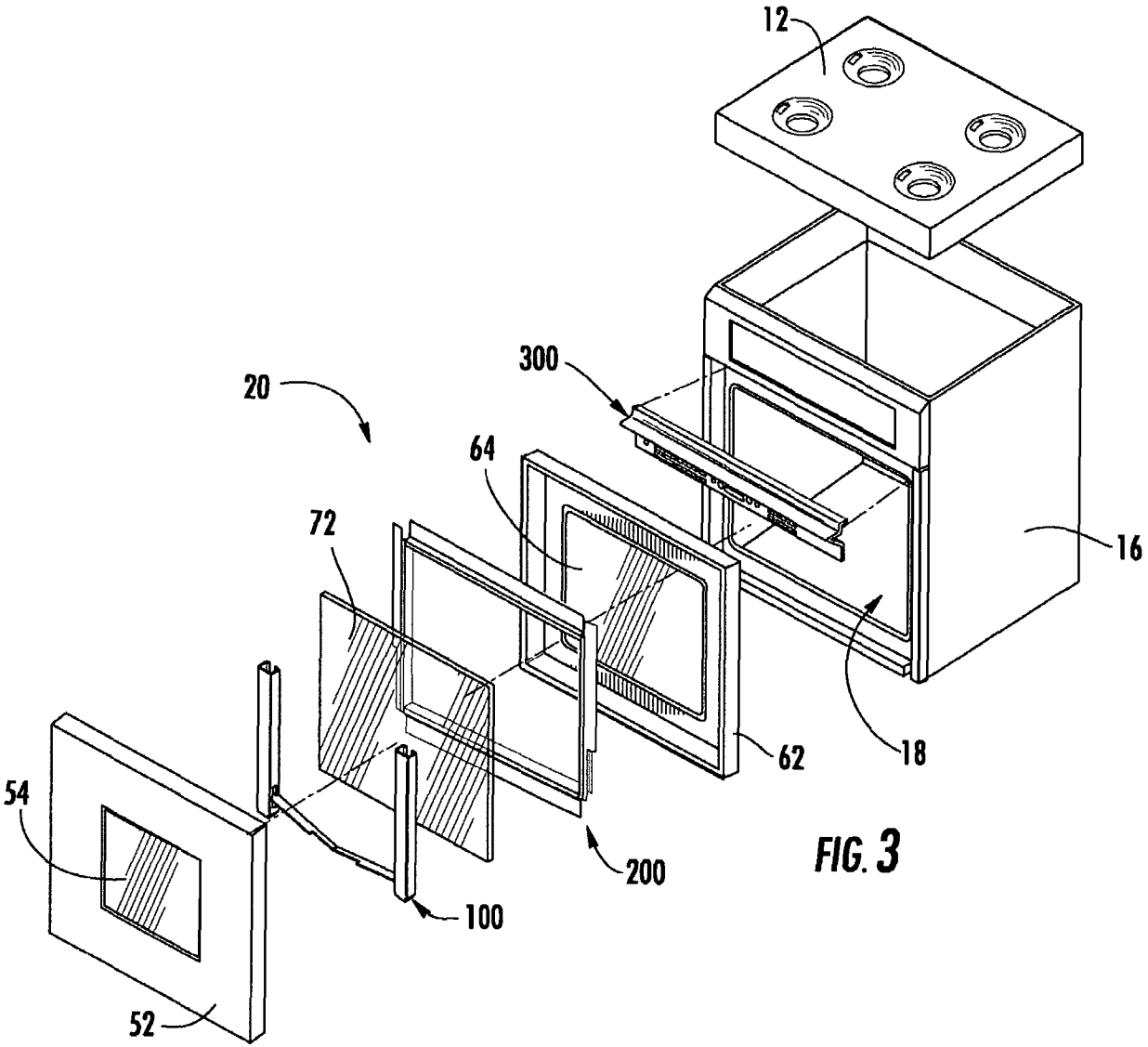
FIG. 3 is an exploded perspective view of an oven door assembly.

Various embodiments of an oven door heat dissipation system will now be described with reference to FIG. 3. Oven door assembly 20, shown in an exploded perspective view in FIG. 3, may include an outside door panel 52 preferably including a glass pane 54 (for viewing the contents of oven cavity 18). Outside door panel 52 and glass pane 54 may be susceptible to excessive temperature from within oven cavity 18, generated for example by element 36 during the oven's self-cleaning cycle. Oven door assembly 20 may also include an inside door panel 62 preferably including a glass pane 64 and that of which forms the inner most component of oven door assembly 20 closest to oven cavity 18. Oven door assembly 20 may also include at least one middle glass pane 72 which is sandwiched between outside door panel 52, inside door panel 62, and other components within oven door assembly 20. Various aspects of the present invention also included in oven door assembly 20 and discussed in further detail below include an air deflection assembly 100 and a glass pack shield 200. FIG. 3 also shows a latch plate shield 300 that will be described in more detail hereinbelow.

Figure 4:
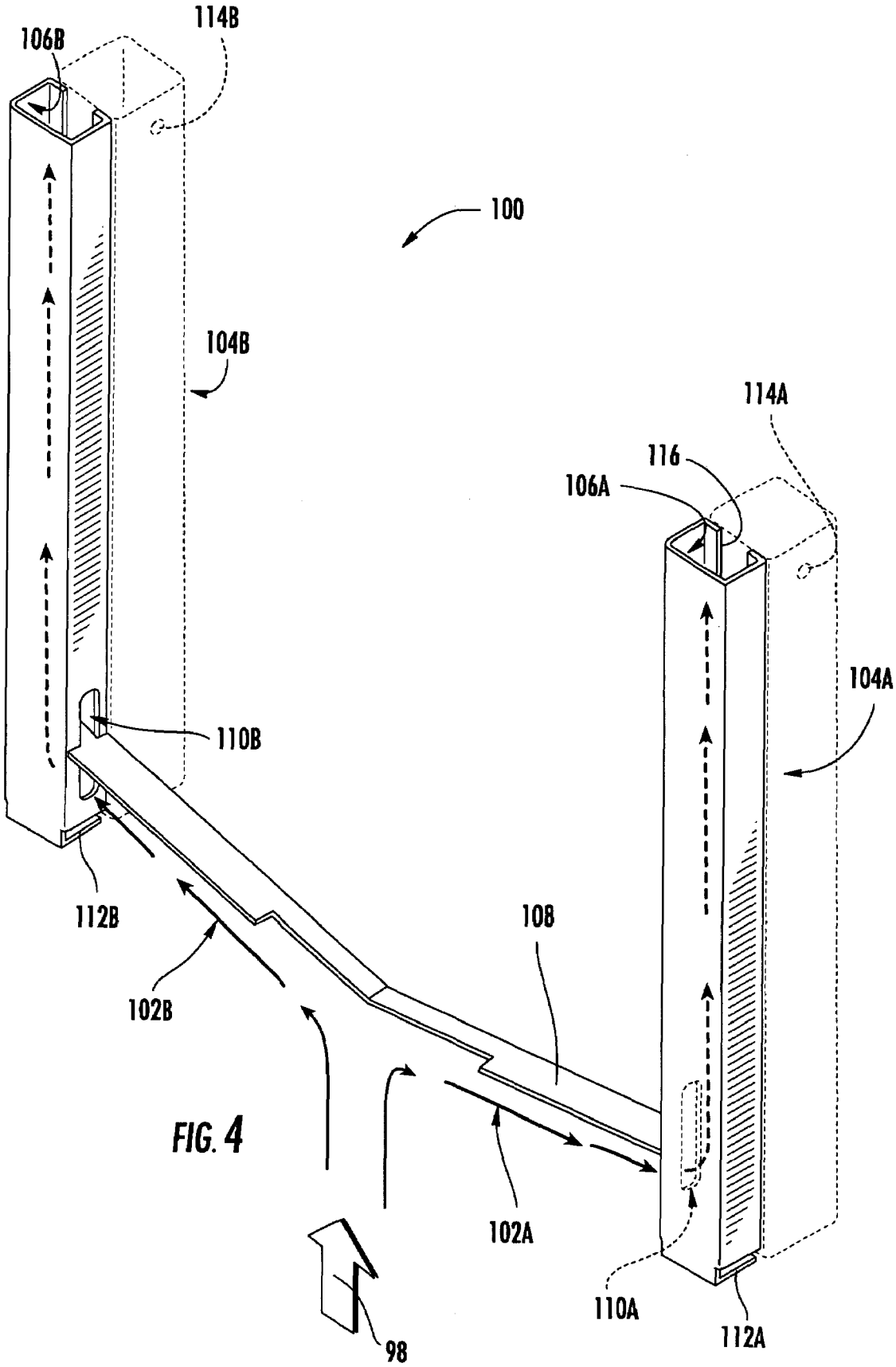
FIG. 4 is a perspective view of a V-shield.

The glass pane 72 is subject to the convection heat of the oven, which may typically be in the range of 300 degrees Fahrenheit up to 500 degrees Fahrenheit. With particular reference now to FIGS. 3 and 4, the air deflection assembly 100 is suitably positioned to promote the transfer of heat away from the glass pane 72 and the air deflection assembly 100 is configured to promote the transfer of heat away from the glass pane 72 via deflecting a first portion of an entry air stream of air 98 from outside the oven into a first branch path 102A and deflecting a second portion of the entry air stream 98 into a second branch path 102B. The door riser extent 104A of the first branch path 102A is formed of a paralleliped-shaped configuration forming an air passage. The door riser extent 104B of the second branch path 102B is formed as well of a paralleliped-shaped configuration.

As seen in FIG. 4, the respective door riser extents 104A, 104B are each formed with a lower entry aperture 110A, 110B, respectively, through which the respective first or second portion of the entry air stream 98 that has been diverted into the respective branch path 102A, 102B, enters the respective door riser extent 104A, 104B. Each of the door riser extents 104A, 104B is provided with a capped bottom portion 112A, 112B, respectively and, as seen in FIG. 4, a complementary riser portion 114A, 114B, is provided to both provide structural support for the oven door assembly and, as well, to generally block an open slot 116 formed in each door riser extent 104A, 104B.

As seen in FIG. 3, the air deflection assembly 100 is disposed intermediate the outer door panel 52 and the glass pane 72 and, accordingly, the air deflection assembly 100 is suitably positioned to promote the transfer of heat away from the glass pane 54. Specifically, as the air deflection assembly 100 receives the relatively more cooler entry air stream 98 and guides the respective first and second portions of this entry air stream along the first branch path 102A and the second branch path 102B, the relatively higher temperature of the glass pane 72 results in a transfer of heat between the glass pane 72 and the air streams flowing through the door riser extents 104A and 104B. This effect results in a cooling of the glass pane 54.

With reference to FIGS. 5, 6, 7A and 7B, the glass pack shield 200 can be provided in oven door 20 to further assist in the dissipation of heat away from the various components of oven door 20, in order to minimize the surface temperature found on outside door panel 52 and the associated glass pane 54. As is known in the art, interior glass panes, such as glass pane 72, may so obstruct the flow of cooling air through the interior region of door assembly 20 that the area of outside door panel 52 and associated glass pane 54 may not receive sufficient convective cooling and may be susceptible to the generation of unacceptable temperatures at their adjacent outside surfaces. Accordingly, a heat collecting and dissipation system would assist in cooling the interior region of door assembly 20. Glass pack shield 200 is designed for several functions including the ability to act as a heat sink to draw heat from glass pane 72, which it is in contact with a portion of glass pack shield 200, and channel that heat, such as through air currents, to slots (not shown) in a wall 66 of inside door panel 62 in order for the heat to flow back into oven cavity 18

Figure 5:
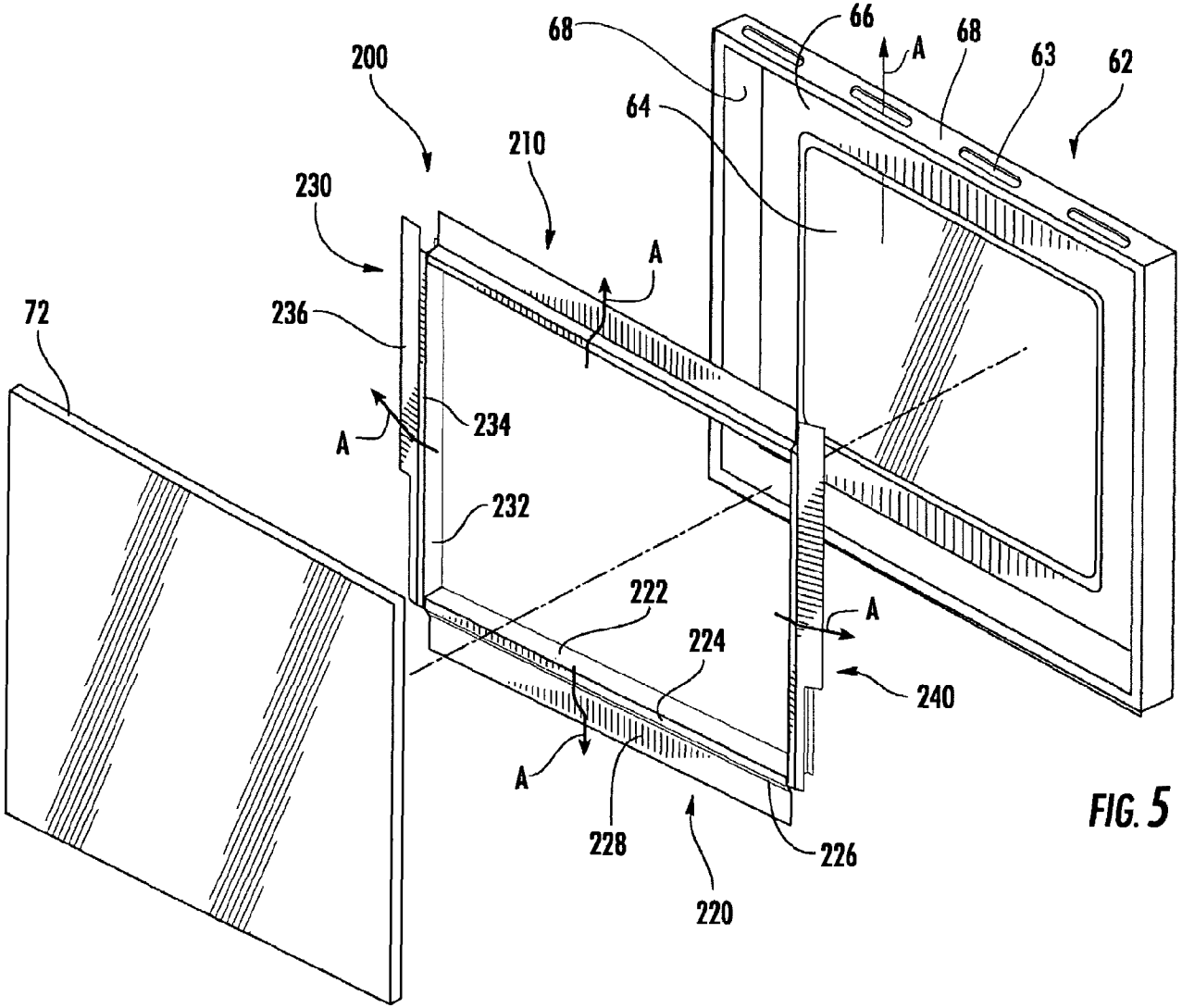
FIG. 5 is a perspective view of a glass pack shield.
Figure 6:
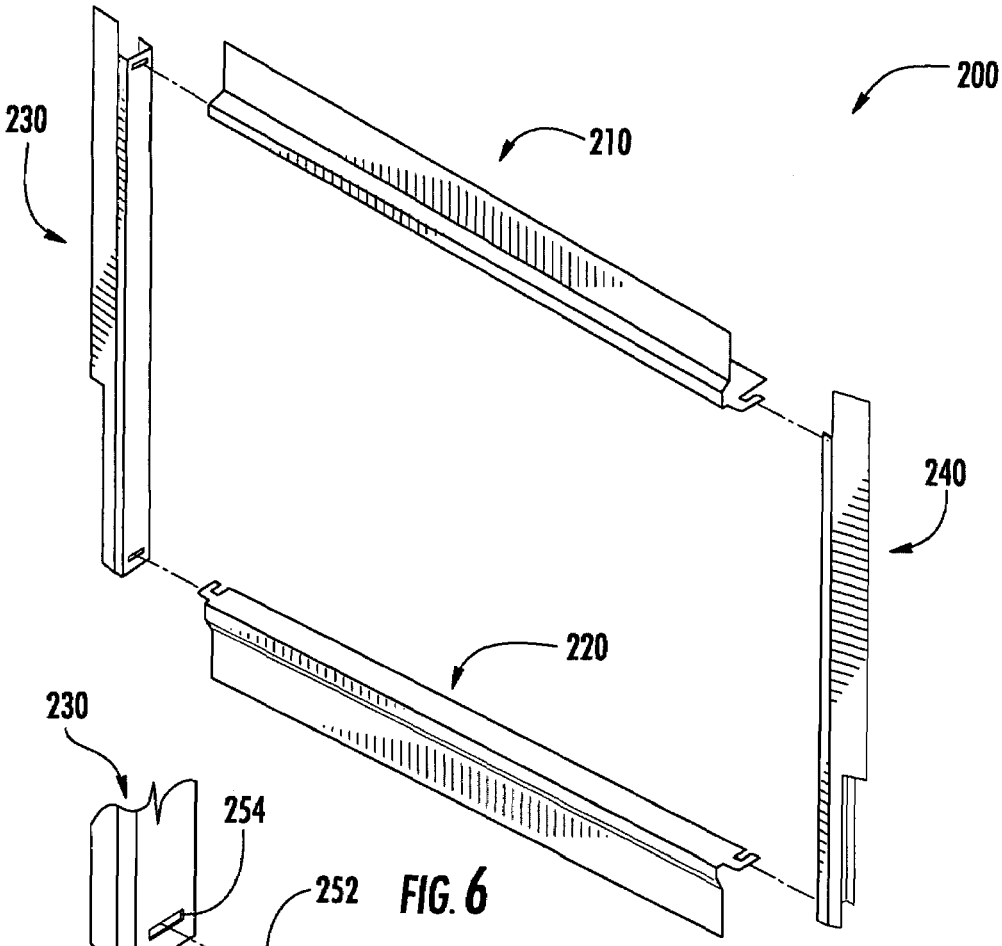
FIG. 6 is an exploded view of the glass pack shield of FIG. 5.

Referring to FIGS. 5 and 6, glass pack shield 200 is preferably constructed of a plurality of elongate members, such as top member 210, bottom member 220, left member 230, and right member 240. While glass pack shield 200 as shown in FIGS. 5 and 6 includes a pair of long leg members 210, 220 and a pair of short leg members 230, 240 which form a generally rectangular shape, it is envisioned that glass pack shield 200 may include any number of a plurality of elongate members to form a variety of shapes. Elongate members 210, 220, 230, 240 can be fixedly attached to one another, such as through spot welding or through the use of fasteners, or can be removably attached as discussed in more detail herein below.

Referring further to FIG. 5, elongate members 210, 220, 230, 240 are constructed in a manner to provide maximum heat dissipation and air flow across their surfaces. Since top member 210 and bottom member 220 can be substantially similar and left member 230 and right member 240 can also be substantially similar, the structure of these members will be discussed with reference to bottom member 220 and left member 230, respectively.

As shown in FIG. 5, each elongate member can include a planar stand-off portion 222, 232 which functions to stand glass pack shield 200 off of wall 66 of inside panel 62. The distance of this stand off and thus the height of stand-off portion 222, 232 is configured to promote good heat dissipation and stand-off portion 222, 232 is typically arranged in a perpendicular manner to wall 66 of inside door panel 62. Each elongate member further comprises a planar central portion 224, 234 which is connected to the edge of stand-off portion 222, 232 opposite that of wall 66. Central portion 224, 234 typically extends from stand-off portion 222, 232 in a substantially perpendicular manner outwardly toward side wall 68 of inside door panel 62. When door assembly 20 is assembled, central portion 224, 234 typically is in contact with glass pane 72 and is able to draw heat therefrom.

In order to influence heated air currents, such as air currents A shown in FIG. 5, each elongate member further comprises a planar angular fin 226, 236 which is connected to the edge of central portion 224, 234 opposite that of where central portion 224, 234 connects to stand-off portion 222, 232. Angular fin 226, 236 typically extends from central portion 224, 234 at an angle away from stand-off portion 222, 232 and downwardly toward wall 66 of inside door panel 62.

As shown with reference to bottom member 220 in FIG. 5, individual elongate members may additionally include a second fin 228 which is connected to the edge of fin 226 opposite that of where fin 226 connects to central portion 224. Second fin 228 typically extends from fin 226 in the same general direction as fin 226 but at less of an angle.

Figure 7A:
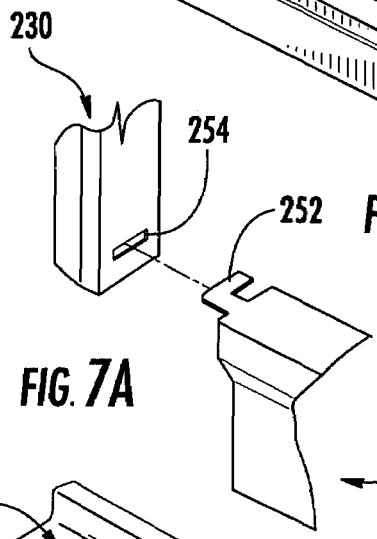
FIG. 7A is an enlarged perspective view of a not yet engaged tab and slot engagement in accordance with one aspect of the glass pack shield.
Figure 7B:
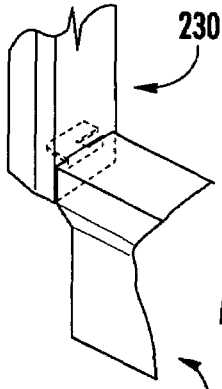
FIG. 7B is an enlarged perspective view of an engaged tab and slot engagement in accordance with one aspect of the glass pack shield.

As discussed hereinabove, elongate members 210, 220, 230, 240 can be fixedly attached to one another, or can be removably attached to one another in order to simplify the construction process. With reference to FIGS. 6, 7A and 7B, elongate members 210, 220, 230, 240 can be removably attached or engaged to one another, and disengaged from one another, through the use of a tab and slot arrangement. As shown, top member 210 and bottom member 220 can have a tab portion 252 on each opposing end and left member 230 and right member 240 can have a slot 254 on each opposing end.

During assembly of glass pack 200, top member 210 and bottom member 220 are positioned so that left member 230 and right member 240 are arranged in a corresponding relationship. Once positioned, each tab portion 252 on top member 210 and bottom member 220 is engaged with an associated slot 254 on left member 230 and right member 240. In this manner, elongate members 210, 220, 230, 240 are interconnected to form glass pack shield 200. It is understood that as opposed to the arrangement shown and described, left member 230 and right member 240 may include tab portion 252 and top member 210 and bottom member 220 may include slot 254, or a mixture of both. It is further envisioned that elongate members 210, 220, 230, 240 can be removably attached through other means such as snap-fit connections, press-fit connections, etc.

As discussed hereinabove, door assembly 20 can be cooled through the use of circulating cooling air that acts as a heat sink picking up heat from various components throughout the door assembly for subsequent discharging and removal. Referring to FIG. 5, such air may include air currents A which comprise air flows around glass pack shield 200 and in between middle glass pane 72 and inside door panel 62. In operation, planar central portion 224, 234 is typically in contact with glass pane 72 and is able to draw heat therefrom. This heat can be further directed down planar angular fin 226, 236 and second fin 228 if present. Air currents A which are passing around elongate members 210, 220, 230, 240 can pick up drawn heat and channel such heat out the door flow exit apertures 24, which are preferably formed on the inside door panel 62 along the top perimeter side wall 68 thereof. Once air currents A exit the door flow exit apertures 24 formed on the inside door panel 62, these air currents may then be directed toward and then through the latch plate 300.

Glass pack shield 200 is preferably made of a material that will withstand the high temperatures produced within oven cavity 18 without cracking or breaking. Metals, ceramics, and even some high temperature plastics are contemplated as suitable materials. Preferably, glass pack shield 200 is made of a heat conducting material that easily reflects and/or dissipates heat to the surrounding air. Metals are the preferred material for construction of glass pack shield 200, with steel being the preferred metal. A coating to protect the metal from corrosion at high temperatures is preferably used. Most commonly, steel is coated with another metal that is more reactive in the electromotive series, so that, in the presence of an electrolyte, such as humid air, the coating metal rather than the steel is affected. Zinc (galvanizing) or aluminum coating of the steel are the most preferred coatings, but any coating may be used that will reduce rapid corrosion that is possible from high temperature oxidation. It is also envisioned that glass pack shield 200 may be made of anodized aluminum which typically has high heat reflectivity characteristics, as well as lightweight characteristics. In addition, aluminum is an excellent radiator and spreader of the heat that does pass through glass pack shield 200, which is especially beneficial in transferring heat from glass pack shield 200 to air stream A provided over the outer surface of glass pack shield 200 to assist in cooling the door.

Figure 10:
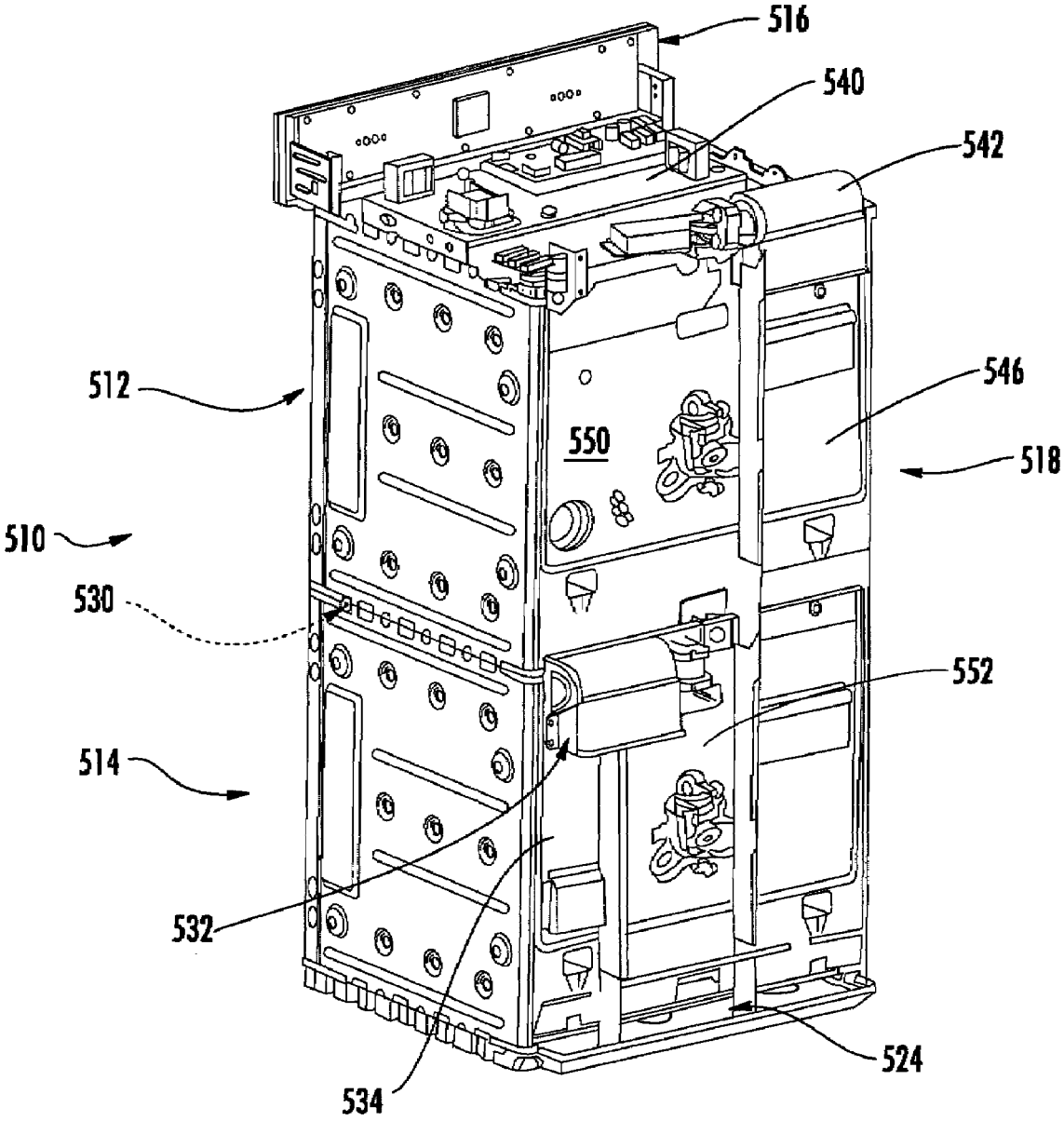
FIG. 10 is a rear perspective view in partial section of the built-in double oven combination shown in FIG. 9.
Figure 11:
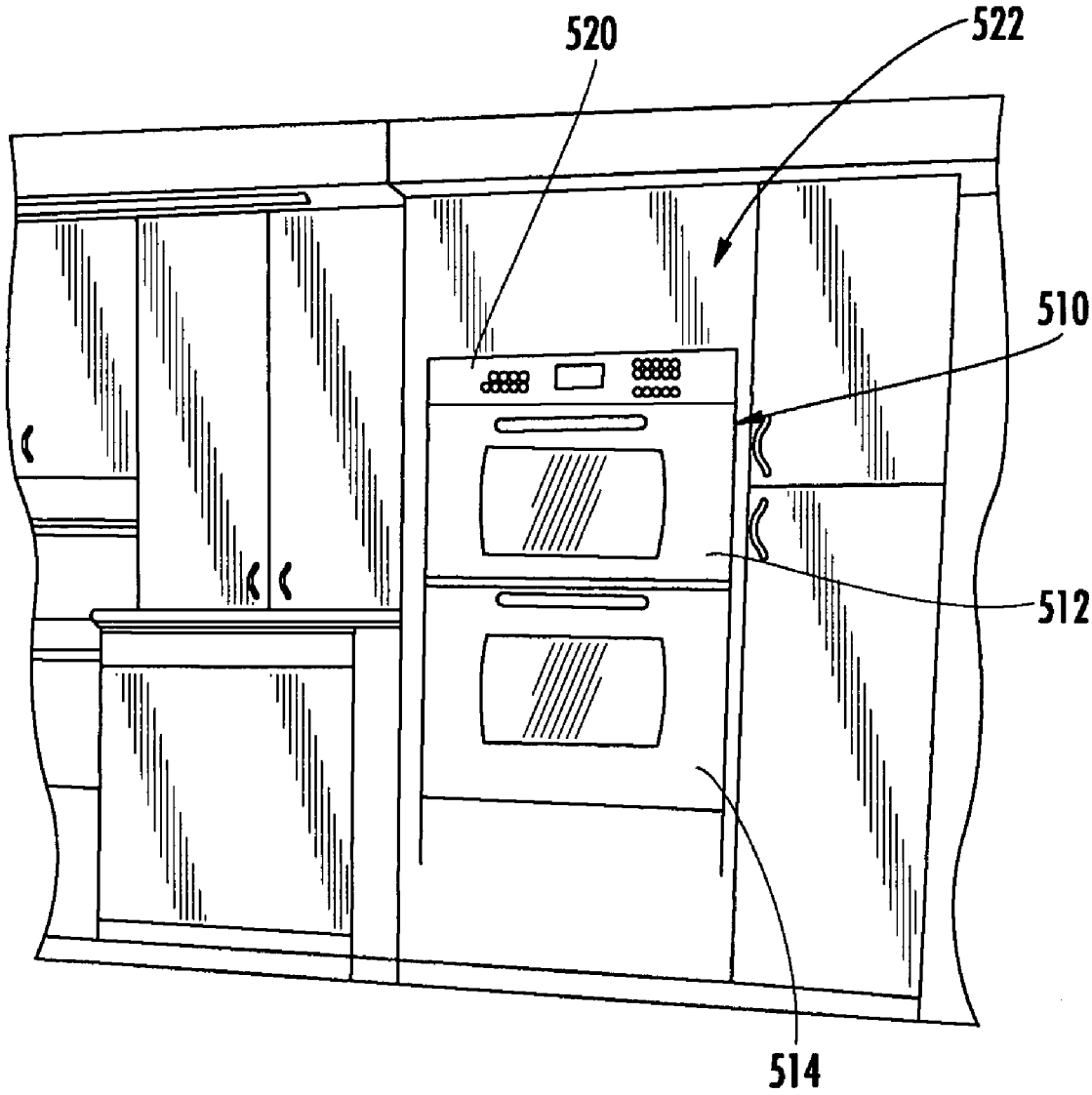
FIG. 11 is a perspective view of the built-in double oven combination shown in FIG. 9 and showing portions of decorative elements of the household area.

Reference is now had to FIG. 9, which is a front plan view of a double oven combination configured to be installed as a built-in combination in an area of a household, FIG. 10, which is a rear perspective view in partial section of the built-in double oven combination shown in FIG. 9, and FIG. 11, which is a perspective view of the built-in double oven combination shown in FIG. 9 and showing portions of decorative elements of the household area. As noted, two units of the oven 10 can comprise the double oven combination—hereinafter generally designated as the double oven combination 510—and this double oven combination 510 is configured to be "built-in" an area of a household—in other words, permanently secured relative to the household area and integrated with other elements of the household area to provide a consistent decorative appearance. The double oven combination 510 shown in FIGS. 9 and 10 comprises two ovens each of which is a unit configured identically to the oven 10 described hereinabove with one of these ovens being denominated as an upper oven 512 and a lower oven 514. The double oven combination 510 further comprises a control panel 516. The upper oven 512 and the lower oven 514 are each configured as a convection oven that cooks and heats food and other substances via radiant and convective heating.

As seen in particular in FIG. 10, the double oven combination 510 has an integrated cooling air and exhaust air flow arrangement, generally designated as the integrated air flow arrangement 518, for efficiently guiding exhaust air away from the upper oven 512 and the lower oven 514 while at the same time effectively flowing cooling air relative to the double oven combination 510 to promote desired cooling of the double oven combination 510.

As seen in FIG. 11, the double oven combination 510 can be suitably attached to an appropriate mounting structure in, for example, a kitchen of a residential home or in another setting. In this regard, it is may be desirable that the double oven combination 510 be mounted in a recessed disposition, whereby a front fascia 520 of the control panel 516, as well the respective fronts of the upper oven 512 and the lower oven 514, are substantially parallel to and, if desired, flush, with certain decorative elements of the portion of a kitchen in which the double oven combination 510 is installed, such as, for example, a decorative element in the form of a decorative panel 522. The installed disposition of the double oven combination 510 in a recessed manner relative to certain decorative elements of the kitchen results in certain structural support elements and decorative elements of the kitchen being in relatively close proximity to the bottom, sides, rear, and top sides of the double oven combination 510. This multiplicity of adjacent elements of the kitchen and the double oven combination 510 imposes a particular need to provide a competent arrangement for efficiently guiding exhaust air away from the upper oven and the lower oven while at the same time effectively flowing cooling air relative to the double oven combination to promote desired cooling of the double oven combination and the integrated air flow arrangement 518 is particularly configured to handle this need.

Figure 12:
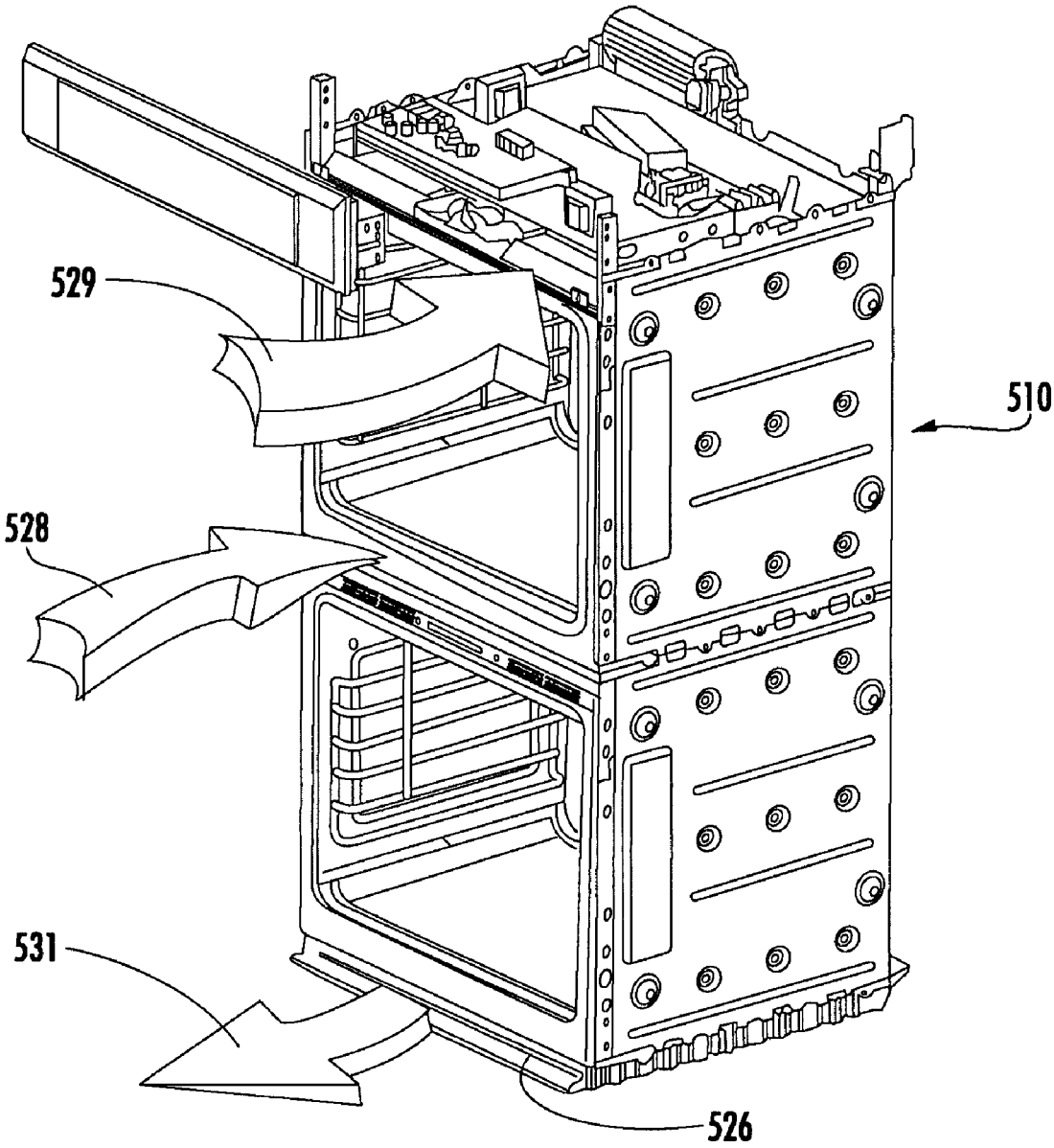
FIG. 12 is a front perspective view in partial section of the built-in double oven combination shown in FIG. 9.

As seen in particular in FIG. 10, the integrated air flow arrangement 518 integrates a plurality of air guiding structures configured to guide cooling air relative to the double oven combination 510 with a plurality of exhaust structures configured to guide exhaust air from the ovens. As seen in FIG. 12, which is a front perspective view in partial section of the built-in double oven combination 510, and FIG. 13, which is a rear perspective view in partial section of the built-in double oven combination 510, cooling air in the form of air at the ambient kitchen temperature is drawn in the double oven combination 510 via several entry locations, this drawn-in cooling air is selectively combined with exhaust air exiting the oven cavities of the upper oven 512 and the lower oven 514 via respective dedicated exhaust duct structures, the combined cooling air and exhaust air streams are ultimately combined with a cooling air only stream at a base channel 524 below the lower oven 514, and all of these air streams then exit the double oven combination 510 at an floor grille exit element 526 near the floor of the kitchen.

Figure 13:
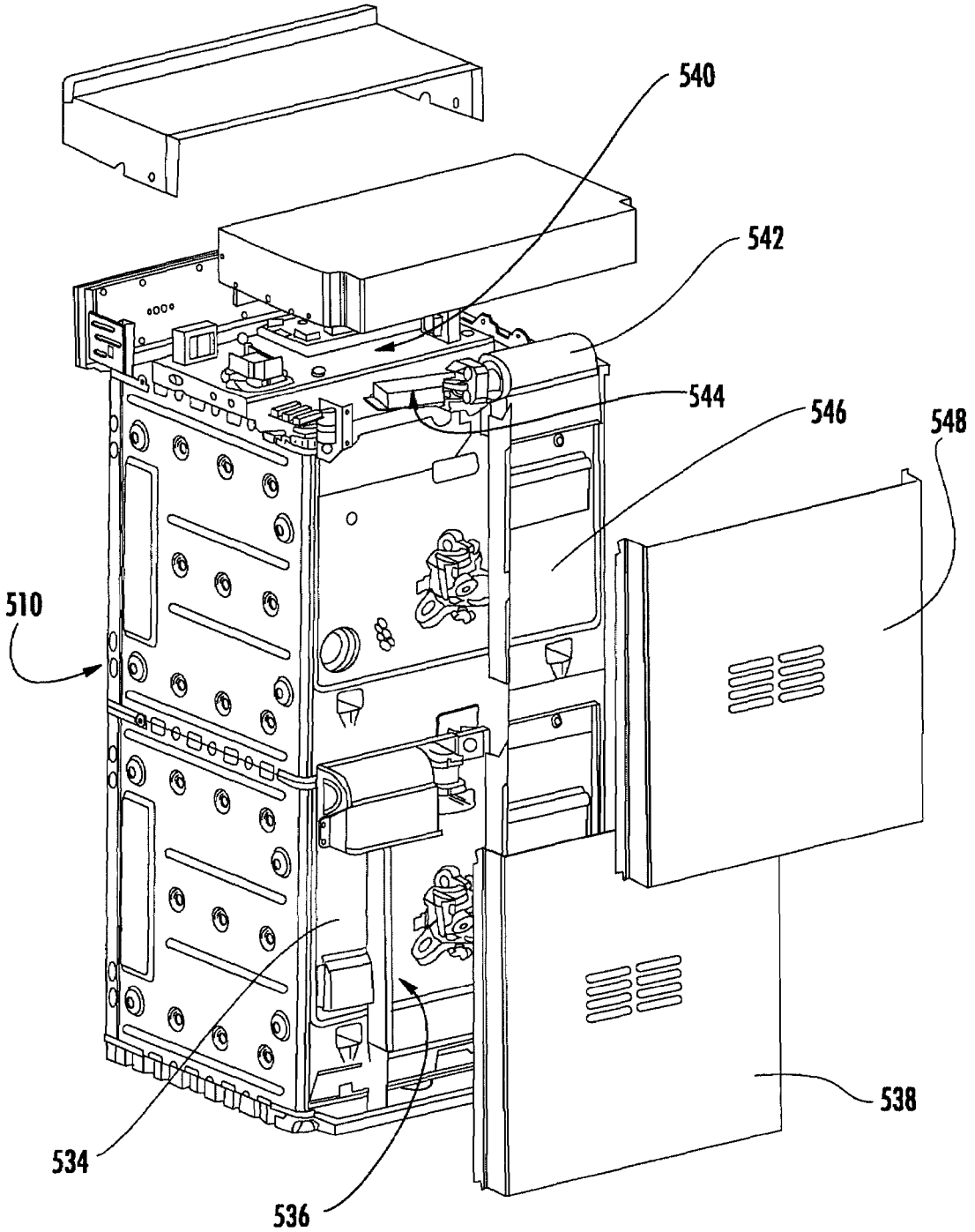
FIG. 13 is a rear perspective view in partial section of the built-in double oven combination shown in FIG. 9 and showing outer housing portions of the double oven combination.

As seen in FIGS. 12 and 13, a lower cooling air stream 528 in the form of air at the ambient kitchen temperature is drawn in the double oven combination 510 via the nose latch plate of the lower oven 514 and an upper cooling air stream 528 in the form of air at the ambient kitchen temperature is drawn in the double oven combination 510 via the nose latch plate of the upper oven 512. The lower cooling air stream 528 is immediately combined with exhaust air exiting the top of the oven door of the lower oven 514 once the lower cooling air stream 528 has passed through the nose latch plate of the lower oven 514 and this combined cooling air-exhaust air stream flows in a rearward direction in a between oven channel 530 located above the lower oven 514 and below the upper oven 512. A lower fan unit 532 provides motive power for promoting rearward movement of the combined cooling air-exhaust air stream in the channel 530 and additionally promotes downward movement of the combined cooling air-exhaust air stream along a mid-rise back channel 534 extending between the channel 530 and the base channel 524. The mid-rise back channel 534 is in the form of a duct structure formed by an interior back wall 536 of the lower oven 514 and an outer housing element 538, as seen in FIG. 13.

As seen in FIGS. 12 and 13, the upper cooling air stream 529 in the form of air at the ambient kitchen temperature is drawn in the double oven combination 510 via the nose latch plate of the upper oven 512 and flows rearwardly along a top channel 540 toward an upper fan unit 542. Exhaust air exits the upper oven 512 via a plenum 544 and combines with the upper cooling air stream 528 shortly upstream of the upper fan unit 542. The upper fan unit 542 provides motive power for promoting downward movement of the combined cooling air-exhaust air stream along a top-rise back channel 546 extending between the top channel 540 and the base channel 524. The top-rise back channel 546 is in the form of a duct structure formed by an interior back wall 550 of the upper oven 512 and an outer housing element 548, forming an upper duct portion, and the interior back wall 536 of the lower oven 514 and the outer housing element 538, forming a lower duct portion, as seen in FIG. 13.

Cooling air also flows along a cooling air only flow path 552 formed between the interior back wall 550 of the upper oven 512, the outer housing element 548, the interior back wall 536 of the lower oven 514, and the outer housing element 538 and this cooling air only flow path 552 comprises cooling air that has entered the double oven combination 510 via the upper cooling air stream 529 but which has not combined with exhaust air exiting the upper oven 512 via the plenum 544. Such cooling air flows downwardly in the volume bounded by the interior back wall 550 of the upper oven 512, the outer housing element 548, the interior back wall 536 of the lower oven 514, and the outer housing element 538 outside of, or exterior to, the mid-rise back channel 534 and the top-rise back channel 546. The cooling air flowing along the cooling air only flow path 552 ultimately flows into the base channel 524 to combine with each of the combined cooling air-exhaust air stream exiting the mid-rise back channel 534 and the top-rise back channel 546 and, thereafter, to exit the double oven combination 510 via the floor grille exit element 526.

Figure 8:
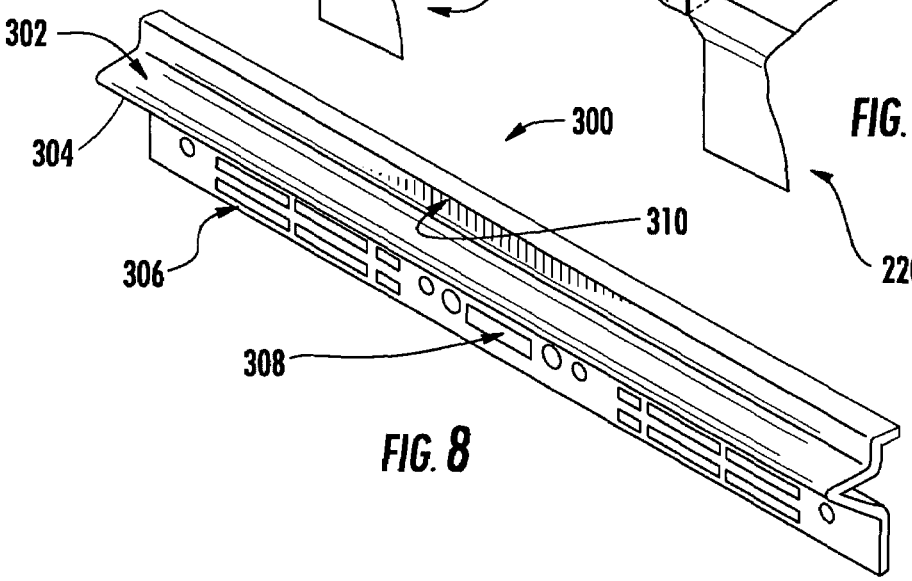
FIG. 8 is a perspective view of a nose latch plate.

With particular reference now to FIG. 12, it can be seen that the latch plate shield 300 is located above the oven cavity of the lower oven 514 and at a top front portion of the frame 16 of the lower oven. The latch plate shield 300 is particularly configured to guide the air exiting the door 20 of the lower oven 514 into the between oven channel 530 located above the lower oven 514 and below the upper oven 512 while, at the same time, guiding cooling air into the between oven channel 530. As seen in FIG. 8, the latch plate shield 300 is preferably formed of steel, stainless steel, or other suitable steel or alloy material that is formed with selected apertures and geometric configurations. The latch plate shield 300 includes an elongate protruding bill element 302 that protrudes outwardly (in the direction toward the household area in which the double oven is installed) and the extent of this outward protrusion (i.e., the depth) of the protruding bill element 302 is selected such that an outermost edge 304 of the protruding bill element 302 extends nearly to the inside surface of the door 20 of the lower oven 514 when the door 20 of the lower oven 514 is in its oven cavity closing disposition. Additionally, the latch plate shield 300 is mounted on the frame 16 of the lower oven 514 such that the outermost edge 304 of the protruding bill element 302 is slightly vertically lower than the top surface of the door 20 of the lower oven 514—that is, the uppermost horizontal surface of the door 20 of the lower oven 514 when the door 20 is in its oven cavity closing disposition. The latch plate shield 300 also includes a plurality of door air receipt apertures 316 (FIG. 14) formed in the latch plate shield 300 below the protruding bill element 302, a latch hook through hole 306 formed longitudinally centrally in the latch plate shield 300 below the protruding bill element 302, and a plurality of cooling air entry apertures 308 formed above the protruding bill element 302. A latch hook (not illustrated) extends through the latch hook through hole 306 to engage corresponding latching structure (not illustrated) on the door 20.

Air that has passed through the interior of the door 20 of the lower oven 514 has acquired more heat content, as has been described hereinabove with respect to the operations of the air deflection assembly 100 and the glass pack shield 200, and the heated air ultimately exits the door 20 of the lower oven 514 through the plurality of door flow exit apertures 24 formed in the top surface of the door 20 of the lower oven 514 The configuration of the protruding bill element 302 and its installed disposition relative to the door 20 of the lower oven 514 leads to the effect that heated air exiting the door 20 via door flow exit apertures 24 formed in the top surface of the door 20 is deflected or guided by the protruding bill element 302 to flow through the latch plate shield 300 and thereafter into the between oven channel 530.

Figure 14:
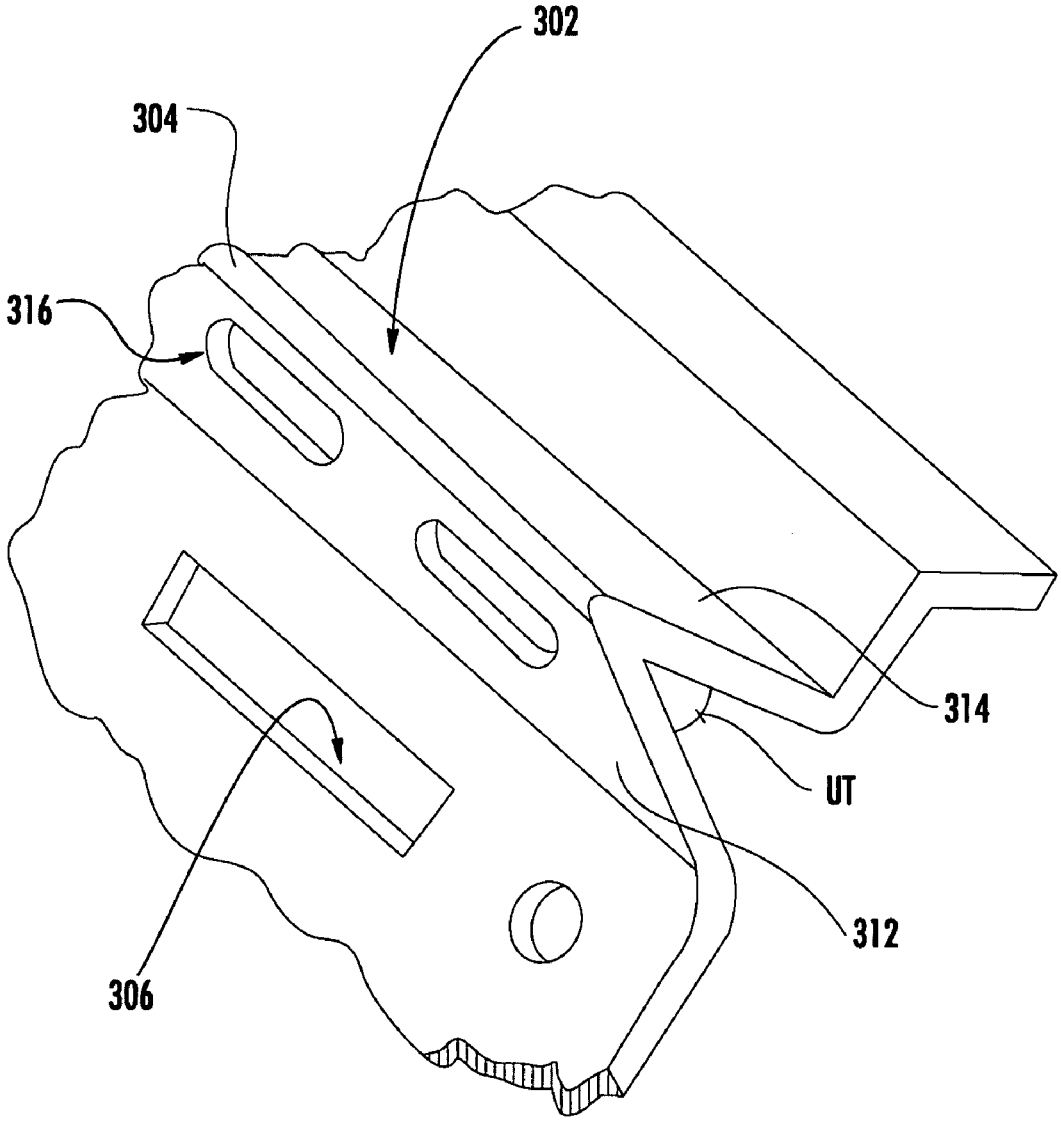
FIG. 14 is an enlarged perspective view of a portion of the nose latch plate shown in FIG. 8.

As seen in FIG. 14, which is an enlarged perspective view of a portion of the nose latch plate shown in FIG. 8, the protruding bill element 302 is formed as an elongate portion having an underside extent 312 and a topside extent 314. The underside extent 312 and a topside extent 314 together form the outermost edge 304 and the underside extent 312 and a topside extent 314 form an included acute angle UT. A plurality of underside apertures 316 are formed on the underside extent 312 of the protruding bill element 302 and each of these underside apertures 316 may have any desired shape such as, as is illustrated in FIG. 14, an elongate shape. The underside apertures 316 extend completely through the underside extent 312 of the protruding bill element 302 and operate to permit the passage therethrough of heated air exiting the door 20 via door flow exit apertures 24 formed in the top surface of the door 20. Heated air that has passed through these underside apertures 316 thereafter passes into oven channel 530. Thus, it can be understood that the protruding bill element 302 promotes the flow of heated air exiting the door 20 via door flow exit apertures 24 formed in the top surface of the door 20 through either the door air receipt apertures 306 of the latch plate shield 300 or the underside apertures 316 extending through the underside extent 312 of the protruding bill element 302.

The cooling air entry apertures 308 formed above the protruding bill element 302 are arranged relative to the protruding bill element 302 such that cooling air in the form of ambient room temperature air is guided by the protruding bill element 302 toward and then into the cooling air entry apertures 308, whereupon the cooling air thereafter enters into oven channel 530 to mix therein with the heated air that has exited the door 20 and subsequently been guided by the latch plate shield 300 into oven channel 530.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. An integrated cooling air and exhaust air flow arrangement for influencing the heat dissipation of a double oven combination formed of two ovens arranged with one oven above and relatively proximate to the other oven, the double oven combination adapted to be installed into an area of a structure, the integrated cooling air and exhaust air flow arrangement comprising:

a first air guiding path for guiding a mixture of cooling air and air that has been exhausted from the upper oven downwardly to a base channel extending below the lower oven, the first air guiding path receiving cooling air that has entered via a cooling air entry above the upper oven;

a second air guiding path for guiding a mixture of cooling air and air that has been exhausted from the lower oven downwardly to the base channel extending below the lower oven, the second air guiding path including a mid-channel formed above the lower oven and below the upper oven with cooling air entering the mid-channel from outwardly of the upper and lower ovens and mixing in the mid-channel with heated air that has exited a top portion of an oven door that selectively closes and permits access to an access opening of an oven cavity of the lower oven; and a cooling air only guiding path for guiding cooling air downwardly to the base channel extending below the lower oven, the cooling air only guiding path extending from the cooling air entry above the upper oven to the base channel extending below the lower oven and the cooling air only guiding path being segregated from the first air guiding path and the second air guiding path.

2. The integrated cooling air and exhaust air flow arrangement according to claim 1 and further comprising a latch plate shield located above the access opening of the oven cavity of the lower oven and below the upper oven, the latch plate shield being cooperatively configured with respect to the top portion of the oven door of the lower oven for influencing heated air exiting the top portion of the oven door to enter the mid-channel of the second air guiding path and latch plate shield assembly including at least one cooling air aperture for the entry of cooling air into the mid-channel of the second air guiding path, whereby the integrated cooling air and exhaust air flow arrangement efficiently guides exhaust air away from the upper oven and the lower oven while at the same time effectively flowing cooling air relative to the double oven combination to promote desired cooling of the double oven combination.

3. The integrated cooling air and exhaust air flow arrangement according to claim 2, wherein the latch plate shield includes a protruding bill element that protrudes outwardly in the direction toward the area of the structure in which the double oven is installed.

4. The integrated cooling air and exhaust air flow arrangement according to claim 3, wherein the protruding bill element includes an outermost edge that extends nearly to an inside surface of the oven door of the lower oven when the oven door is in its oven cavity closing disposition.

5. The integrated cooling air and exhaust air flow arrangement according to claim 4, wherein the latch plate shield includes a plurality of door air receipt apertures formed in the latch plate shield below the protruding bill element, a latch hook through hole formed longitudinally centrally in the latch plate shield below the protruding bill element, and a plurality of cooling air entry apertures formed above the protruding bill element.

* * * * *